US006083043A

United States Patent [19]

Lok

[11] Patent Number: 6,083,043

[45] Date of Patent: Jul. 4, 2000

[54] FASTENING DEVICE FOR AN ELECTRICAL CONNECTOR

[75] Inventor: Gordon Lok, Montebello, Calif.

[73] Assignee: Hon Hai Precision Ind. Co., Ltd., Taipei Hsien, Taiwan

[21] Appl. No.: 09/221,760

[22] Filed: Dec. 28, 1998

[51] Int. Cl.[7] ..... H01R 13/60

[52] U.S. Cl. ..... 439/567

[58] Field of Search ..... 411/508–509, 913, 411/514; 439/567, 527, 607, 81–84, 329

[56] References Cited

U.S. PATENT DOCUMENTS 3,492,627 1/1970 Tauscher ..... 439/82
5,192,228 3/1993 Collins et al. ..... 439/567

*Primary Examiner*—Gary F. Paumen
*Assistant Examiner*—Phuongchi Nguyen
*Attorney, Agent, or Firm*—Wei Te Chung

[57] ABSTRACT

An electrical connector includes a housing enclosed by an EMI shield having fastening devices integrally extending downward therefrom. Each fastening device has a substantially hour-glass shape with an opening defined therethrough thereby forming two resilient side portions. The fastening devices are inserted through corresponding holes defined in the PCB whereby a diagonal section and an upper protrusion of each side portion are positioned above the PCB, a curved section of each side portion abuts against an inner surface of the hole of the PCB, and a lower protrusion of each side portion and a horizontal section of the fastening device are positioned below the PCB thereby ensuring that the connector is stably mounted thereon.

1 Claim, 3 Drawing Sheets

FASTENING DEVICE FOR AN ELECTRICAL CONNECTOR

BACKGROUND OF THE INVENTION

1. Field of The Invention

The present invention relates to a fastening device for an electrical connector, and particularly to a fastening device for an electrical connector which can be stably engaged with a printed circuit board.

2. The Prior Art

Electrical connectors are often directly mounted to a printed circuit board by means of fastening devices such as board locks. At least a pair of board locks is interferentially engaged with inner walls of slots defined in a bottom surface of a housing of the connector. A resilient portion extending beyond the bottom surface of the housing is received in a hole defined in the printed circuit board whereby the connector is mounted thereto. The related prior art is disclosed in Taiwan Patent Application Nos. 80204998, 80211753, and 81210551, and U.S. Pat. Nos. 4,907,987, 5,057,027, 5,074,807, 5,080,611, 5,135,412, 5,184,963, 5,411,404, and U.S. Pat. No. 5,547,385.

A conventional board lock disclosed in U.S. Pat. No. 4,907,987 comprises a main body engaged with a connector and having an elongate projection downwardly extending therefrom for retention in a PCB whereby the connector is mounted thereon. A slot is defined in the projection thereby forming two resilient spring members on opposite sides thereof. A pair of barbs outwardly extend from each spring member whereby the board lock can be interferentially retained within an aperture defined in the PCB. However, the interferential fit between the barbs and an inner surface of the aperture may not be stable whereby the board lock may move within the slot, thus, the connector may become disengaged from the PCB. Furthermore, the main body of the board lock may not be securely engaged with the connector thereby resulting in a loose fit therebetween which may adversely affect signal transmission.

Hence, an improved fastening device is requisite to eliminate the above mentioned defects of current fastening devices.

SUMMARY OF THE INVENTION

Accordingly, an objective of the present invention is to provide a fastening device for an electrical connector having a retention portion engaging with top and bottom surfaces of a PCB whereby the connector can be stably mounted thereon.

Another objective of the present invention is to provide a fastening device for an electrical connector which is integrally formed with an outer shield thereof.

To fulfill the above mentioned objectives, an electrical connector in accordance with the present invention includes a housing enclosed by an EMI shield having fastening devices integrally extending downward therefrom. Each fastening device has a substantially hour-glass shape with an opening defined therethrough thereby forming two resilient side portions. The fastening devices are inserted through corresponding holes defined in the PCB whereby a diagonal section and an upper protrusion of each side portion are positioned above the PCB, a curved section of each side portion abuts against an inner surface of the hole of the PCB, and a lower protrusion of each side portion and a horizontal section of the fastening device are positioned below the PCB thereby ensuring that the connector is stably mounted thereon.

These and additional objectives, features, and advantages of the present invention will become apparent after reading the following detailed description of the preferred embodiments of the invention taken in conjunction with the appended drawing figures.

DETAILED DESCRIPTION OF THE PREFERRED EMBODIMENT

Reference will now be made in detail to the preferred embodiment of the present invention.

Figure 1:
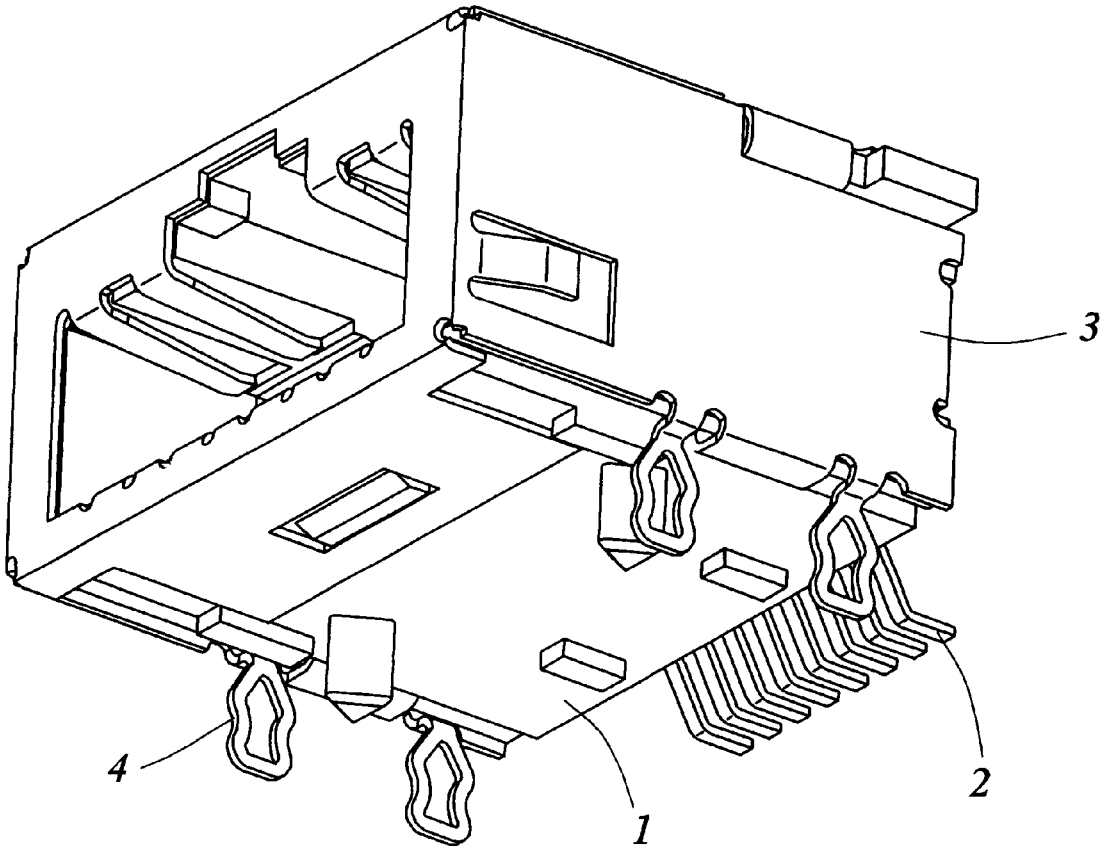
FIG. 1 is a perspective view of an electrical connector incorporating a fastening device in accordance with the present invention.
Figure 2:
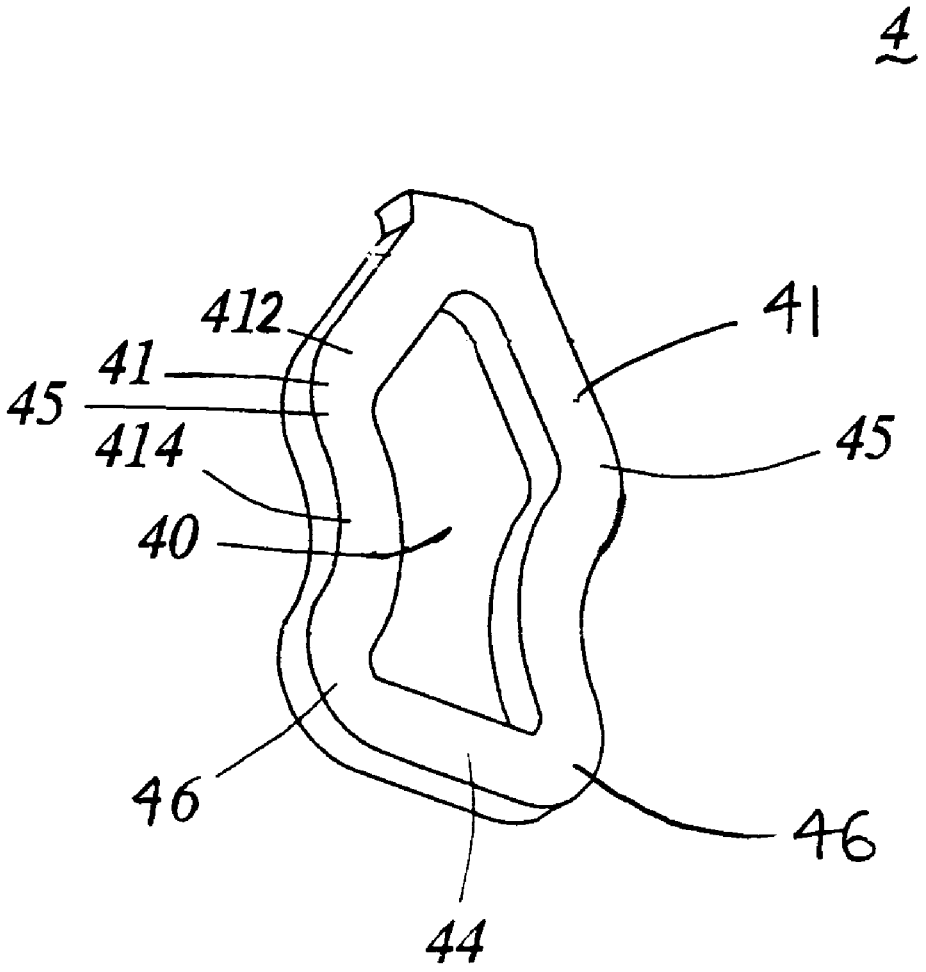
FIG. 2 is a magnified view of FIG. 1 showing the fastening device in more detail.
Figure 3:
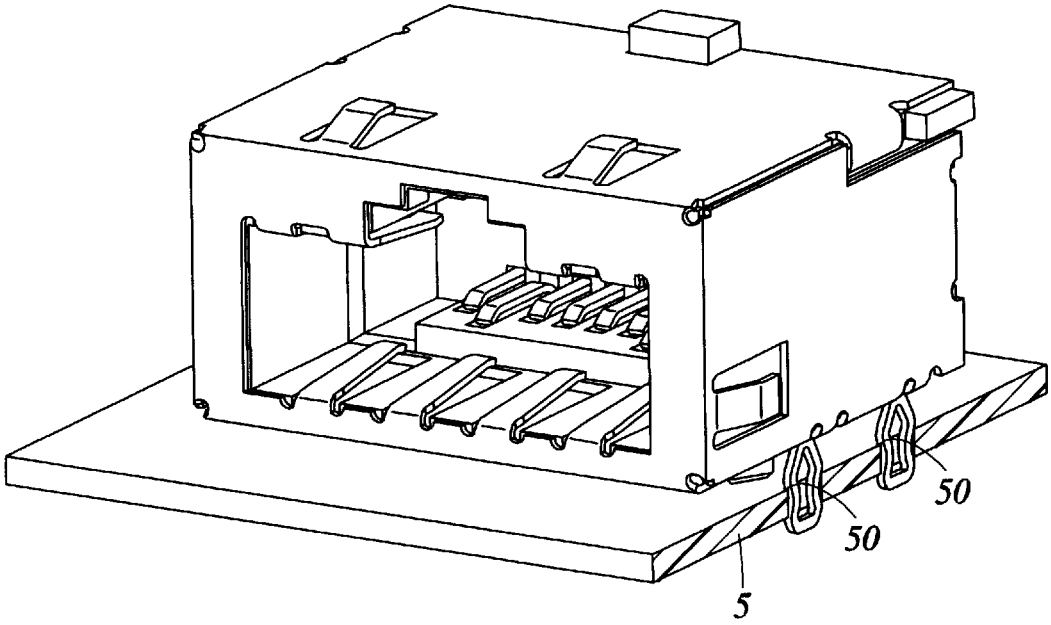
FIG. 3 is a side view of the connector of FIG. 1 mounted on a PCB.

Referring to FIGS. 1, 2, and 3, an electrical connector in accordance with the present invention includes a housing 1 receiving a number of contacts 2 therein and enclosed by an EMI shield 3 having fastening devices 4 integrally formed with the shield 3 and extending downward therefrom for mounting the connector onto a PCB 5.

In the embodiment shown, a pair of fastening devices 4 is formed downwardly extending from each lateral side 31 of the shield 3. Each fastening device 4 has a main face 43 continuous with a referenced face 311 of a corresponding side 31 of the shield 3 and an edge 42 continuous with an edge 312 of the side 31 of the shield 3. A width of the edge 42 which is equal to a thickness of the shield 3 is far smaller than a width of the main face 43. Each fastening device 4 has a substantially hour-glass shape as viewed normal to the main face 43 of the fastening device 4. Furthermore, each fastening device 4 is provided with an opening 40 defined therethrough thereby forming two resilient side portions 41. Each side portion 41 includes a diagonal section 412 outwardly extending from the shield 3 and a curved section 414 extending concavely from the diagonal section 412. A horizontal section 44 connects ends of the two curved sections 414. Upper protrusions 45 are formed extending from outer surfaces of each side portion 41 at a junction between the diagonal section 412 and the curved section 414, and lower protrusions 46 are formed extending from outer surfaces of each side portion 41 at a junction between the curved section 414 and the horizontal section 44.

The fastening devices 4 are inserted through corresponding holes 50 defined in the PCB 5 whereby the lower protrusions 46 slide along inner surfaces of the hole 50 until passing therethrough and the curved sections 414 abut against the inner surface of the hole 50. Thus, the upper protrusions 45 and the lower protrusions 46 are positioned above and below the PCB 5, respectively. The resiliency of the side portions 41 due to the provision of the opening 40 facilitates insertion of the fastening device 4 into the hole 50 of the PCB 5. The provision of the curved section 414 and the protrusions 45, 46 ensures that the fastening device 4 is stably retained within the hole 50 of the PCB 5. It is also understood that in some situation, each curved section 414 may generally contact the corresponding hole 50 at two points, of which one is close to the upper protrusion 45 for engagement with the upper edge of the hole 50 and the other is close to the lower protrusion 46 for engagement with the lower edge of the hole 50 as shown in FIG. 3.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

I claim:

1. An electrical connector including a housing receiving a number of contacts therein and a metal shield surrounding the housing, the shield having a number of fastening devices extending downward therefrom for mounting the connector onto a PCB, each fastening device having a main face continuous with a referenced face of the shield and an edge continuous with an edge of the shield, each fastening device having a substantially hour-glass shape as viewed normal to the main face and provided with an opening defined therethrough, thereby defining two resilient side portions, wherein when the fastening devices are inserted through corresponding holes defined in the PCB, the resiliency of the side portions due to the provision of the opening facilitates insertion of the fastening devices into the holes of the PCB;

wherein the fastening devices are integrally formed with the shield;

wherein each side portion includes a diagonal section outwardly extending from the shield and a curved section extending concavely from the diagonal section;

wherein a horizontal section connects ends of the curved sections;

wherein upper protrusions are formed extending from outer surfaces of each side portion at a junction between the diagonal section and the curved section, and wherein lower protrusions are formed extending from outer surfaces of each side portion at a junction between the curved section and the horizontal section.

* * * * *